US006067949A

United States Patent [19]

Hughes et al.

[11] Patent Number: 6,067,949

[45] Date of Patent: May 30, 2000

[54] INTAKE MANIFOLD FOR MOTORCYCLE ENGINE

[76] Inventors: Terry Hughes, 2124 Kirkland Lake Dr., Auburndale, Fla. 33823; Charles E. Scales, 3410 Ave. F NW., Winterhaven, Fla. 33880

[21] Appl. No.: 09/360,976

[22] Filed: Jul. 27, 1999

[51] Int. Cl.[7] ..... F02M 35/10

[52] U.S. Cl. ..... 123/184.34; 123/184.24

[58] Field of Search ..... 123/184.24, 184.31, 123/184.32, 184.34, 184.46, 184.47

[56] References Cited

U.S. PATENT DOCUMENTS

| | | | |
|---|---|---|---|
| 2,806,457 | 9/1957 | Moseley | 123/184.32 |
| 2,947,293 | 8/1960 | Arkus-Duntov | 123/184.34 |
| 3,520,284 | 7/1970 | Ruoff et al. | 123/184.34 |
| 4,013,049 | 3/1977 | Dilgard et al. | 123/52 M |
| 4,210,107 | 7/1980 | Shaffer | 123/52 M |
| 4,932,367 | 6/1990 | Newman et al. | 123/52 MV |
| 5,494,011 | 2/1996 | Haller | 123/184.32 |

FOREIGN PATENT DOCUMENTS

| | | | |
|---|---|---|---|
| 207173 | 1/1960 | Austria | 123/184.31 |

*Primary Examiner*—Marguerite McMahon
*Assistant Examiner*—Katrina B. Harris
*Attorney, Agent, or Firm*—A.W. Fisher, III

[57] ABSTRACT

An intake manifold for use with a downdraft carburetor of a motorcycle engine having a plurality of cylinders comprising a plenum to receive a mixture of fuel and air from the venturi of the downdraft carburetor, the plenum being in fluid communication with the plurality of cylinders of the motorcycle engine through a corresponding plurality of fuel air feed tubes, each fuel air feed tube including a transition section and a supply section coupled to a corresponding manifold outlet port and a corresponding feed tube outlet port respectively to feed the mixture of fuel and air from the downdraft carburetor to the cylinders of the motorcycle engine.

19 Claims, 4 Drawing Sheets

INTAKE MANIFOLD FOR MOTORCYCLE ENGINE

BACKGROUND OF THE INVENTION

1. Field of the Invention

An intake manifold for use with a downdraft carburetor of a motorcycle engine having a plurality of cylinders.

2. Description of the Prior Art

Often multi-cylinder internal combustion engines have a plurality of separate carburetors for each cylinder which require extensive maintenance. On the other hand, such engines may use a single manifold for fuel/air distribution to the individual cylinders. However, there remains a need for an efficient intake manifold for motorcycle engines.

U.S. Pat. No. 5,850,813 teaches a substantially Y shaped split intake manifold having fuel-air outlet conduits coupled to a plurality of internal combustion engine cylinder inlet ports.

U.S. Pat. No. 5,809,960 shows an intake pipe for an internal combustion engine to prevent the transfer of the vibrations to a carburetor. The intake pipe includes an intake pipe body connected to an outlet portion of a carburetor. The intake pipe body and two-intake pipe mounting flanges are formed as integral members.

U.S. Pat. No. 5,494,011 discloses an intake manifold for a combustion engine. Having a body with a front end, a back end, a top and a bottom. The bottom has a first angled portion; a second angled portion and a horizontal portion located therebetween. The intake manifold fur has a front end plate and a back end plate connected to respective ends of the body. The top plate has at least one opening for connecting at least one carburetor system to the intake manifold. The intake manifold further has a first and second engine mounting plate and a plurality of straight tubes each having a first and a second end. The straight tubes are connected at their first end to the body of the intake manifold and at their second end to the engine mounting plates.

U.S. Pat. No. 5,042,435 describes an intake manifold for twin carburetors or twin air control throat bodies for a motorcycle having one or more cylinders where the physical space is limited comprising a hollow central plenum chamber and hollow carburetor or air control throat body mounting flanges on each side adjacent. At least one side communicating with the intake track of at least one cylinder. In the case of two opposing cylinders, each cylinder communicates with the hollow central plenum chamber through opposing openings and the perpendicularly mounted carburetors or air control bodies. When a cylinder intakes a fuel mixture from the carburetors the fuel mixture from each carburetor converge in the hollow plenum chamber where the direction of flow is turned toward the cylinder without physical impact with a physical structure during direction change.

U.S. Pat. No. 4,934,342 relates to an intake manifold with left and right intake passages located respectively in left and right cylinder banks of an internal combustion vee-engine. The intake manifold comprises a single inlet passage portion, and two branch passage portions which branch from an outlet end of the inlet passage portion and which communicate respectively with the intake passages.

U.S. Pat. No. 4,872,424 shows an intake manifold. for use with a combustion engine having a lower manifold unit with lower runner portions and a lower plenum portion and upper manifold unit with an intake manifold opening surrounded by a carburetor mounting flanges, upper runner portions and upper plenum. When the upper and lower manifold units are assembled, the upper and lower plenum portions form a plenum chamber in fluid communication with the intake opening and the upper and lower runner portions forms plurality of intake runners between the plenum chamber and the respective cylinders each of which has an outlet port and a surrounding passageway side wall. The unit is constructed so that each outlet port is aligned in fluid communication with a respective cylinder intake port. Baffle means are removably mounted as part of the assembled unit for directing flow of the fuel mixture and form a relatively uninterrupted extension of each of the respective flow passageways.

U.S. Pat. No. 4,381,738 with adjacent expansible chambers of an engine provided with an intake runner set at least three runner passages conducting the working fluid from a common plenum to the expansible chambers, with at least one of the runners only serving one of the expansible chambers, at least another of the runners serving only the other expansible chamber, and at least still another of the runners commonly serving both of the expansible chambers.

U.S. Pat. No. 4,013,049 relates to an intake manifold having a plurality of upwardly extending headers connected to a single distribution manifold for use with a downdraft carburetor on a multi-cylinder motorcycle.

U.S. Pat. No. 3,247,834 describes a manifold structure comprising a housing, a chamber, a plurality of inlet ports provided in the housing in communication with the chamber for directing a fuel-air mixture thereto, baffle means in the housing and extending into a portion of chamber and being interposed between the single ports of associated pairs of inlet ports for separating the initial incoming flow of the fuel-air mixture, a plurality of spaced outlet ports provided in the housing and in communication with the chamber for exhausting the fuel-air mixture therefrom, the inlet ports and outlet ports in common communication with the chamber whereby each outlet port is provided with a uniform mixture and volume thereof for discharge from the chamber.

U.S. Pat. No. 2,013,737 discloses a manifold for gas engines having an intake, a distributing zone in communication with intake and four branches extending from the zone. Each branch has an independent discharge end spaced substantially apart from the other ends, the four branches being disposed so that a pair occupies in part a substantially parallel relationship with the pairs extending in relatively opposite directions from the distributing zone, one branch being relatively short as compared to the other branch of the same pair to secure said spacing of the discharge ends, and the inside corner of each branch where it communicates with its discharge end being such as to effect an abrupt turn, the formation of each branch adjoining its discharge and being formed to constitute recessed portions beyond the discharge end presenting with the latter abrupt corners.

FR 2384-120 teaches an engine with a suction manifold with six cylinder connections. The branches leave the manifold in pairs. The two branches of each pair being opposite each other on the manifold. Each branch has a straight section leaving the manifold and passing into a curved section leading to the cylinder inlet.

SUMMARY OF THE INVENTION

The present invention relates to an intake manifold for use with a downdraft carburetor on a four or six cylinder motorcycle engine. The intake manifold comprises a plenum having a first and second substantially parallel substantially vertical side wall held in spaced relationship relative to each other by a first and second substantially parallel substantially vertical end wall, a substantially flat lower bottom plate and a substantially flat upper carburetor mounting plate. The upper carburetor mounting plate has an aperture formed therein to receive a fuel air mixture from the venturi of the downdraft carburetor.

A plurality of fuel air feed tubes, coupled to the first and second substantially vertical side walls, are in fluid communication with the plenum and a corresponding intake port of a cylinder of the motorcycle. Each fuel air feed tube comprises a transition section adjacent the plenum and a tubular supply section adjacent the intake port of a corresponding cylinder on the motorcycle engine.

In order to reduce fluid turbulence within the manifold housing, curvilinear transition surfaces are formed between the first substantially vertical side wall and the second substantially vertical end wall, and between the second substantially vertical end wall and the second substantially vertical end wall.

In use, vacuum created by the operation of the motorcycle engine draws air downward through the venturi of the downdraft carburetor where the air is mixed with atomized fuel. The resulting stream of fuel air vapor is then drawn out of the discharge port of the carburetor venturi and into the interior of the plenum. The fuel air vapor stream is then periodically drawn in to each fuel air tube.

The diagonal opposition of the horizontal banks of fuel air feed tubes disposed on opposite sides of the plenum, and the fuel air vapor stream directed into a circular flow pattern parallel to the plane of the substantially flat lower bottom plate facilitates the introduction of the fuel air vapor stream into the transition section of each of the fuel air tubes.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be made to the following detailed description taken in connection with the accompanying drawings in which.

Similar reference characters refer to similar parts throughout the several views of the drawings.

DETAILED DESCRIPTION OF THE INVENTION

Figure 1:
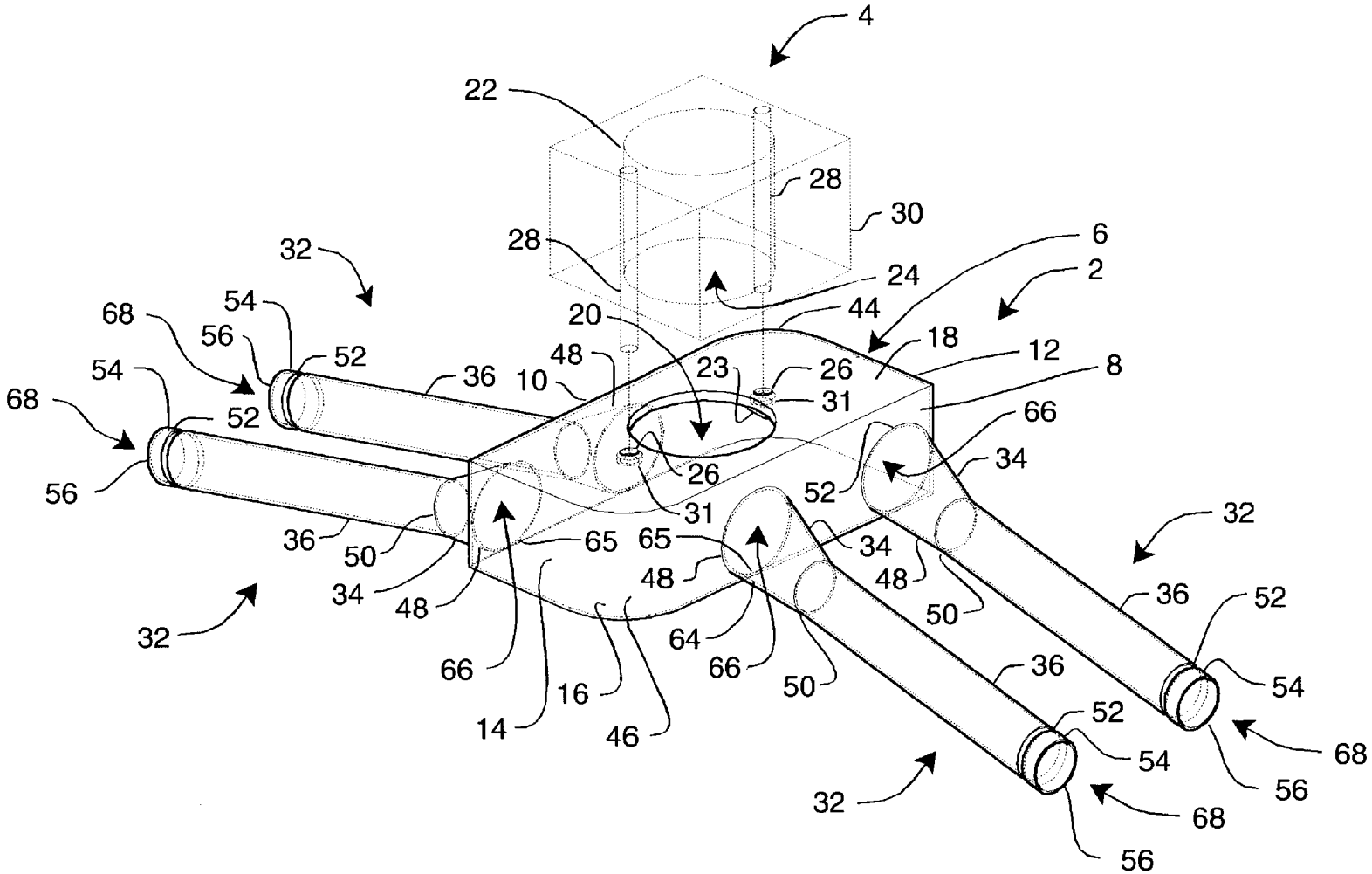
FIG. 1 is a perspective view of the intake manifold of the present invention for use with a four cylinder motorcycle engine.
Figure 2:
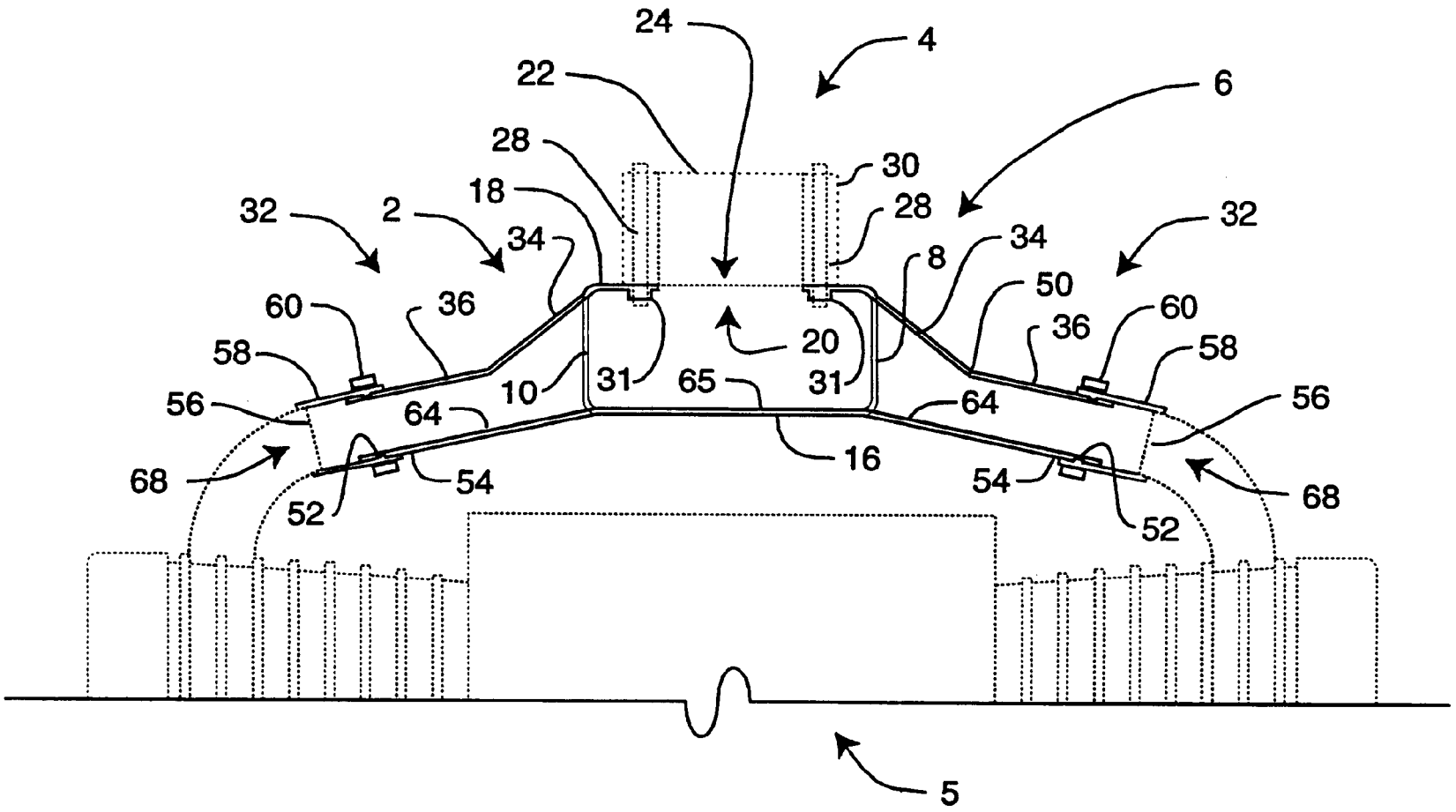
FIG. 2 is an end view of the intake manifold of the present invention shown in FIG. 1.

As shown in FIGS. 1 and 2, the present invention relates to an intake manifold generally indicated as 2 for use with a downdraft carburetor generally indicated as 4 on a four or six cylinder motorcycle engine generally indicated as 5. The intake manifold 2 comprises a plenum generally indicated as 6 including a first substantially vertical side wall 8 and a substantially parallel opposing second substantially vertical side wall 10 disposed between a first substantially vertical end wall 12 and a substantially parallel opposing second substantially vertical end wall 14. The substantially vertical side walls 8 and 10, and the substantially vertical end walls 12 and 14 are disposed between a substantially flat lower bottom plate 16 and a substantially flat upper carburetor mounting plate 18.

The substantially flat upper carburetor mounting plate 18 has a supply aperture 20 formed therein to receive a mixture of a fuel and air from the venturi 22 of the downdraft carburetor 4. The supply aperture 20 is located on the upper carburetor mounting plate 18 in registry or operative alignment with a discharge port 24 formed in the venturi 22 of the downdraft carburetor 4. A diffuser plate or member 23 is formed or disposed on the inside surface of the substantially flat upper carburetor mounting plate 18 adjacent the supply aperture 20 and the discharge port 24 to diffuse or atomize the fuel/air mixture from the downdraft carburetor 4. A carburetor attachment means is formed on the upper carburetor mounting plate 18 to secure the downdraft carburetor 4 to the intake manifold 2. The carburetor attachment means comprises at least two threaded openings each indicated as 26 formed in the substantially flat upper carburetor mounting plate 18 to operatively receive a corresponding threaded rod or bolt 28 extending through the carburetor housing 30 of the downdraft carburetor 4. The inside surface of the substantially flat upper carburetor mounting plate 18 includes a raised portion or protrusion 31 to reinforce the area around each threaded opening 26.

As shown in FIGS. 1 and 2, a plurality of fuel air feed tubes each generally indicated as 32, coupled to the first and second substantially vertical side walls 8 and 10, are in fluid communication with the plenum 6 and a corresponding intake port of a cylinder of the motorcycle engine 5 as described more fully hereinafter. Specifically the first substantially vertical side wall 8 has a first bank of horizontally spaced apart fuel air feed tubes 32; while, the second substantially vertical side wall 10 has a second bank of horizontally spaced apart fuel air feed tubes 32 in offset alignment relative to the first bank of horizontally spaced apart fuel air feed tubes 32. In order to reduce fluid turbulence with the housing 30, curvilinear transition surfaces 44 and 46 are formed between the first substantially vertical side wall 8 and the second substantially vertical end wall 14, and between the second substantially vertical side wall 10 and the second substantially vertical end wall 12 respectively.

Each fuel air feed tube 32 includes a substantially cone shaped or funnel transition section 34 adjacent the plenum 6 and a substantially tubular elongated supply section 36 adjacent the intake port of a corresponding cylinder on the motorcycle engine 5. The substantially cone shaped or funnel transition section 34 of each fuel air feed tube 32 is coupled to the corresponding substantially vertical side wall 8 or 10 at the inlet end portion 48 thereof and to the substantially tubular elongated supply section 36 at the smaller outlet end portion 50 thereof. The substantially tubular elongated supply section 36 includes a intake port coupling means comprising a race 52 formed on the outer surface 54 of the distal portion end 56 of the fuel air feed tube 32 to receive a ridge formed on the inner surface of a flexible boot 58 received by the corresponding intake port of the motorcycle engine 5 which is held in place by a common hose clamp 60 or similar securing device. The lower peripherial edge 64 of each fuel air feed tube 32 is disposed at or below the upper surface 65 of the substantially flat lower bottom plate 16 of the plenum 6 at the intersection of the substantially flat lower bottom plate 16 and the substantially vertical side wall 10 or the substantially vertical side wall 12. The lower surface of the substantially cone shaped or funnel transition section 34 is inclined at an angle in the range of from about 0° to about 15° relative to the substantially flat lower bottom plate 16.

In use, vacuum created by the operation of the motorcycle engine draws air downward through the venturi 22 of the downdraft carburetor 4 where the air is with atomized fuel. The resulting stream of fuel air vapor is then drawn out of the discharge port 24 of the carburetor venturi 22 through the supply aperture 20 and into the interior of the plenum 6. The fuel air vapor stream is then periodically drawn into each fuel air feed tube 32 through a corresponding manifold outlet port 66 and to the corresponding cylinder through the corresponding feed tube outlet port 68. The manifold outlet ports 66 of the fuel air feed tubes 32 disposed opposite the curvilinear transition surface or directional control surfaces 44 and 46 are disposed adjacent the first and second substantially vertical end walls 8 and 10 respectively. As a result of the combined affects of the curvilinear transition surfaces 44, and 46, and the diagonal opposition of the first and second banks of fuel air feed tubes 32, the fuel air vapor stream is directed into circular flow pattern parallel to the plane of the substantially flat lower bottom plate 16 thereby facilitating the introduction of the fuel air vapor stream into the substantially cone shaped or funnel transition section 34 of each fuel air feed tube 32.

Figure 3:
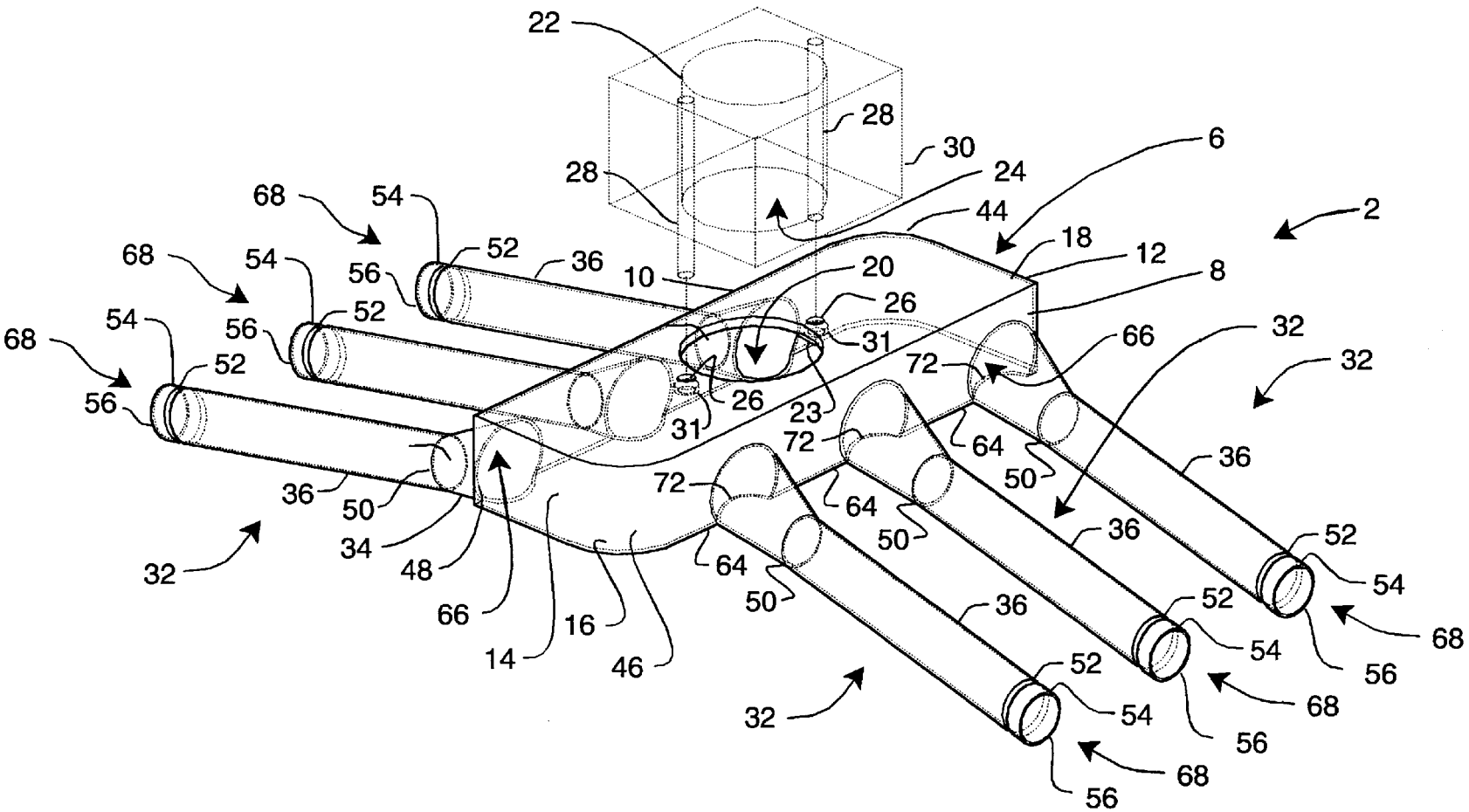
FIG. 3 is a perspective view of the intake manifold in the present invention for use with a six cylinder motorcycle engine.
Figure 4:
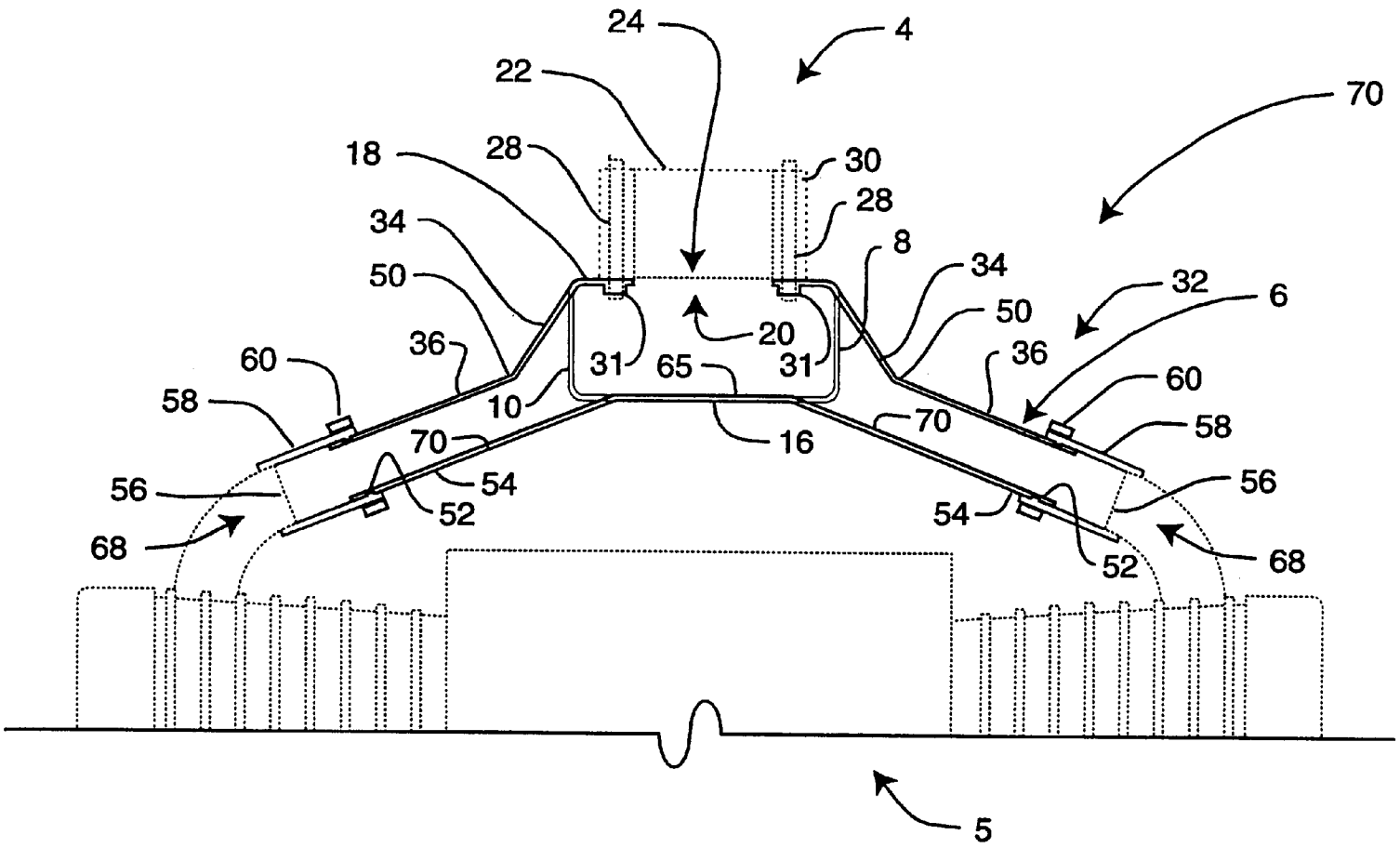
FIG. 4 is an end view of the intake manifold of the present invention shown in FIG. 3.

FIGS. 3 and 4 depicts an alternative embodiment of the intake manifold 2 of the present invention for use on a six cylinder motorcycle engine 5 with similar numeric description for similar structural elements shown in FIGS. 1 and 2. In the alternative embodiment, the intake manifold 2 includes an elongated plenum 6 with scalloped openings 72 formed in the peripheral edge 64 of the substantially flat lower bottom plate 16 to receive the lower peripheral edge 64 of the transition section 34 of each fuel air feed tube 32.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An intake manifold for use with a downdraft carburetor of a motorcycle engine having a plurality of cylinders comprising a plenum to receive a mixture of fuel and air from the venturi of the downdraft carburetor, said plenum being in fluid communication with the plurality of cylinders of the motorcycle engine through a corresponding plurality of fuel air feed tubes, each said fuel air feed tube including a transition section and a supply section coupled to a corresponding manifold outlet port and a corresponding feed tube outlet port respectively to feed the mixture of fuel and air from the downdraft carburetor to the cylinders of the motorcycle engine, said plenum comprises a first and second side wall held in spaced relationship relative to each other by a first and second end wall, a bottom plate and a carburetor mounting plate having an aperture formed therein to receive a fuel air mixture from the downdraft carburetor wherein curvilinear transition surfaces are formed between said first side wall and said second end wall and between said second side wall and said second end wall such that said manifold outlet ports of said fuel air feed tubes disposed opposite said curvilinear transition surface control are disposed adjacent said first and second substantially vertical end walls respectively, creating a circular flow thereby facilitating the introduction of the fuel air vapor stream into said transition section of each said fuel air feed tube, each said fuel air feed tube includes a substantially cone shaped transition section adjacent said plenum and a substantially tubular elongated supply section adjacent the intake port of a corresponding cylinder on the motorcycle engine, said lower peripheral edge of each fuel feed tube is disposed at or below the upper surface of said bottom plate of said plenum at the intersection of said bottom plate and said side wall and said lower surface of said substantially cone shaped or transition section is inclined at an angle in the range of from about 0° to about 15° relative to said bottom plate.

2. The intake manifold of claim 1 wherein a carburetor attachment means is formed on said upper carburetor mounting plate to secure the downdraft carburetor to said intake manifold.

3. The intake manifold of claim 2 wherein said carburetor attachment means comprises at least two threaded openings formed in said upper carburetor mounting plate to operatively receive a corresponding threaded rod extending through the downdraft carburetor.

4. The intake manifold of claim 3 wherein the inside surface of said flat upper carburetor mounting plate includes a raised portion to reinforce the area around each said threaded opening.

5. The intake manifold of claim 1 further including a diffuser plate formed on said flat upper carburetor mounting plate adjacent the supply aperture to diffuse the fuel/air mixture from the downdraft carburetor.

6. An intake manifold for use with an downdraft carburetor on a four or six cylinder motorcycle engine comprising a plenum to receive a fuel air vapor from the venturi of the downdraft carburetor and fuel air in fluid communication with the plenum and with the intake port of one of the cylinders of the multi-cylinder motorcycle engine through at least four fuel air feed tubes intersecting the bottom plate of the plenum at a vertical angle of 0° to 15° below the horizontal plane of the bottom of bottom plate of the plenum.

7. The manifold of claim 6 where said plenum comprises a first parallel opposing substantially vertical side wall and a second parallel opposing substantially vertical side wall disposed between a first parallel opposing substantially vertical end wall and a second substantially vertical parallel opposing end wall and between a substantially flat bottom plate and substantially flat upper carburetor mounting plate.

8. The manifold of claim 7 where said carburetor mounting plate has an aperture formed therein in alignment with the downdraft carburetor to receive a fuel air vapor from the venturi of the downdraft carburetor.

9. The manifold of claim 8 where said carburetor mounting plate includes a carburetor retaining means formed on the upper surface thereof comprising at least two threaded openings to receive threaded members attached to the body of the downdraft carburetor.

10. The manifold of claim 9 where each said parallel opposing substantially vertical side wall includes a horizontal bank of at least two fuel air supply tubes formed therein.

11. The manifold of claim 10 where said plenum includes a vertical curvilinear transition surface formed in opposing corners thereof between the first parallel opposing substantially vertical side wall and the second parallel opposing substantially vertical end wall and between the second parallel opposing substantially vertical end wall and between the second parallel opposing substantially vertical side wall and the first parallel opposing substantially vertical end wall.

12. The manifold of claim 11 where said fuel air feed tubes include a substantially cone shaped transition section adjacent received by the plenum and a fuel air supply section received by the intake port of the motorcycle engine.

13. The manifold of claim 12 where said fuel air supply tube includes an intake port coupling means comprising a race formed on the outer surface of the distal end of the fuel air feed tube.

14. The manifold of claim 13 where the invert of the lower surface of said transition section of the fuel air feed tube intersects the inner surface of the lower plate of the plenum at the point of intersection between the lower plate and parallel opposing substantially vertical side wall.

15. The manifold of claim 14 where the invert of the lower surface of said transition section of the fuel air feed tube intersects the inner surface of the lower plate of the plenum inside of the point of intersection between the lower plate and parallel opposing substantially vertical side wall.

16. The intake manifold of claim 15 wherein the inside surface of said flat upper carburetor mounting plate includes a raised portion to reinforce the area around each said threaded opening.

17. The intake manifold of claim 7 further including a diffuser plate formed on said flat upper carburetor mounting plate adjacent the supply aperture to diffuse the fuel/air mixture from the downdraft carburetor.

18. An intake manifold for use with a downdraft carburetor of a motorcycle engine having a plurality of cylinders comprising a plenum to receive a mixture of fuel and air from the venturi of the downdraft carburetor, said plenum being in fluid communication with the plurality of cylinders of the motorcycle engine through a corresponding plurality of fuel air feed tubes, each said fuel air feed tube including a transition section and a supply section coupled to a corresponding manifold outlet port and a corresponding feed tube outlet port respectively to feed the mixture of fuel and air from the downdraft carburetor to the cylinders of the motorcycle engine, said plenum comprises a first and second side wall held in spaced relationship relative to each other by a first and second end wall, a bottom plate and a carburetor mounting plate having an aperture formed therein to receive a fuel air mixture from the downdraft carburetor and said first side wall has a first bank of horizontally spaced apart fuel air feed tubes and said second side wall has a second bank of horizontally spaced apart fuel air feed tubes in offset alignment relative to said first bank of horizontally spaced apart fuel air feed tubes such that the fuel air vapor stream within said plenum is uniformly distributed to said fuel air feed tubes wherein said lower peripheral edge of each fuel feed tube is disposed at or below the upper surface of said bottom plate of said plenum at the intersection of said bottom plate and said side wall and wherein the lower surface of said substantially cone shaped or transition section is inclined at an angle in the range of from about 0° to about 15° relative to said bottom plate.

19. The intake manifold of claim 18 further including curvilinear transition surfaces formed between said first side wall and said second end wall and between said second side wall and said second end wall to reduce fluid turbulence.

* * * * *